US006398232B1

(12) United States Patent
Dahan

(10) Patent No.: US 6,398,232 B1
(45) Date of Patent: Jun. 4, 2002

(54) CONTOURED ROLLER SKATE FOR EXTREME SKATING

(76) Inventor: Mardoche Marc Dahan, 13634 Hayworth Dr., Potomac, MD (US) 20854

( * ) Notice: Subject to any disclaimer, the term of this patent is extended or adjusted under 35 U.S.C. 154(b) by 0 days.

(21) Appl. No.: 09/878,219

(22) Filed: Jun. 12, 2001

Related U.S. Application Data

(63) Continuation-in-part of application No. 09/576,926, filed on Aug. 16, 2000, now abandoned.

(51) Int. Cl.[7] ..... A63C 17/02; A63C 17/24

(52) U.S. Cl. ..... 280/11.233; 280/11.226; 280/11.27; 301/5.301

(58) Field of Search ..... 105/72.2; 301/5.301, 301/5.7; 280/841, 842, 843, 11.19, 11.221, 11.223, 11.226, 11.227, 11.231, 11.233, 11.25, 11.27

(56) References Cited

U.S. PATENT DOCUMENTS 1,332,702 A * 3/1920 Wisniewski ..... 280/11.233
3,749,413 A * 7/1973 Nicolson ..... 280/842
4,153,263 A * 5/1979 Yoshimoto ..... 280/11.226
4,294,456 A * 10/1981 Tuell et al. ..... 280/11.28
4,838,564 A * 6/1989 Jarvis ..... 280/11.28
5,791,665 A * 8/1998 Mayer, II ..... 280/11.226
5,899,465 A * 5/1999 Mayer, II ..... 280/11.226
5,967,552 A * 10/1999 Roderick et al. ..... 280/843

* cited by examiner

*Primary Examiner*—Michael Mar

(57) ABSTRACT

A roller skate which includes specially shaped front and back wheels which allow the skate to operate on flat ground and over pipes or rails. The skater is able to perform stunts and maneuvers involving pipes or rails of different diameters due to the front and back wheel geometry. The hourglass-shaped cross-section that is created by the configuration of the front and back wheels centers the pipe or rail that is being skated on under the center of balance of each skate. The two front and two back wheels each have a half hourglass shape, and are able to spin independently of each other.

1 Claim, 3 Drawing Sheets

CONTOURED ROLLER SKATE FOR EXTREME SKATING

This application is a Continuation-In-Part of application Ser. No. 09/576,926 filed Aug. 16, 2000 now abandoned.

BACKGROUND OF THE INVENTION

In-line skating has evolved over the past few years into a diverse sport, ranging from traditional road skating to extreme skating involving intricate aerial maneuvers and pipe or rail grinding. A variety of in-line skates are now available to cater to the ever-changing needs of the modern skater.

Today's aggressive skaters can be seen performing a wide range of stunts in skate parks or other public areas. Many of the tricks involve some form of grinding. Grinding can simply be defined as scraping or sliding across pipes, rails, or any edged surface. Grinding can take place in the forward and backward direction, or in the perpendicular direction relative to the wheel configuration. Forward and backward grinding occurs when the skater jumps onto a pipe structure, and grinds with the pipe structure directly parallel and adjacent to the in-line skate wheels. This can occur on either side of the in-line wheels since there is usually sufficient space to do so on the bottom of the boot. Many skate manufacturers are modifying their traditional designs with the addition of grinding plates or added reinforcements to accommodate the high stresses and wear to the skate.

The ability to land extreme skating maneuvers involves obtaining the necessary speed and having the required skill to land precisely in the correct location of both the skate and the pipe.

Many roller skaters may find in-line skating intimidating and difficult due to the lack of stability and balance that roller-skating allows. In-line skating requires the user to maintain a larger amount of independent balance in each ankle due to the layout of the in-line wheels, which allows side to side pivoting. Roller skates have a wheel layout with a wide stance, which prevent the user from being able to pivot in such a manner.

BRIEF SUMMARY OF THE INVENTION

Many skaters carry out forward and backward maneuvers, which grind across the surface which they are engaging. In order to complete such a stunt, a fast enough speed must be attained to allow the skater to grind across the pipe or rail. In addition, maintaining balance while grinding requires much skill and experience, which can be intimidating for the novice or intermediate skater.

This invention demonstrates a remedy for this situation which incorporates specially shaped variable front and back wheels to engage the surface in a rolling manner as opposed to performing a grind. The embodiment of the skate consists of a wheel configuration with two front wheels and two back wheels. The two front wheels and two back wheels spin independently of one another, allowing for variable wheel speeds and stability during turning and other maneuvers. Each wheel has a concave portion between its innermost edge and an outer portion of greatest diameter. When the two wheels are laid out next to each other on the same axle, they form a full hourglass. This shape accommodates regular flat surface skating by utilizing the outer portion of greatest diameter for ground contact on each wheel. The concave portions of each wheel allow the skater to engage curved or edged surfaces.

The skate's wheel configuration also allows the user to have more balance while skating. In addition, the amount of contact the skate has with the ground is no more than the four points that a traditional in-line skate maintains with the ground. This enables the user to attain faster speeds and more control than a traditional roller skate.

DETAILED DESCRIPTION OF THE INVENTION

Figure 1:
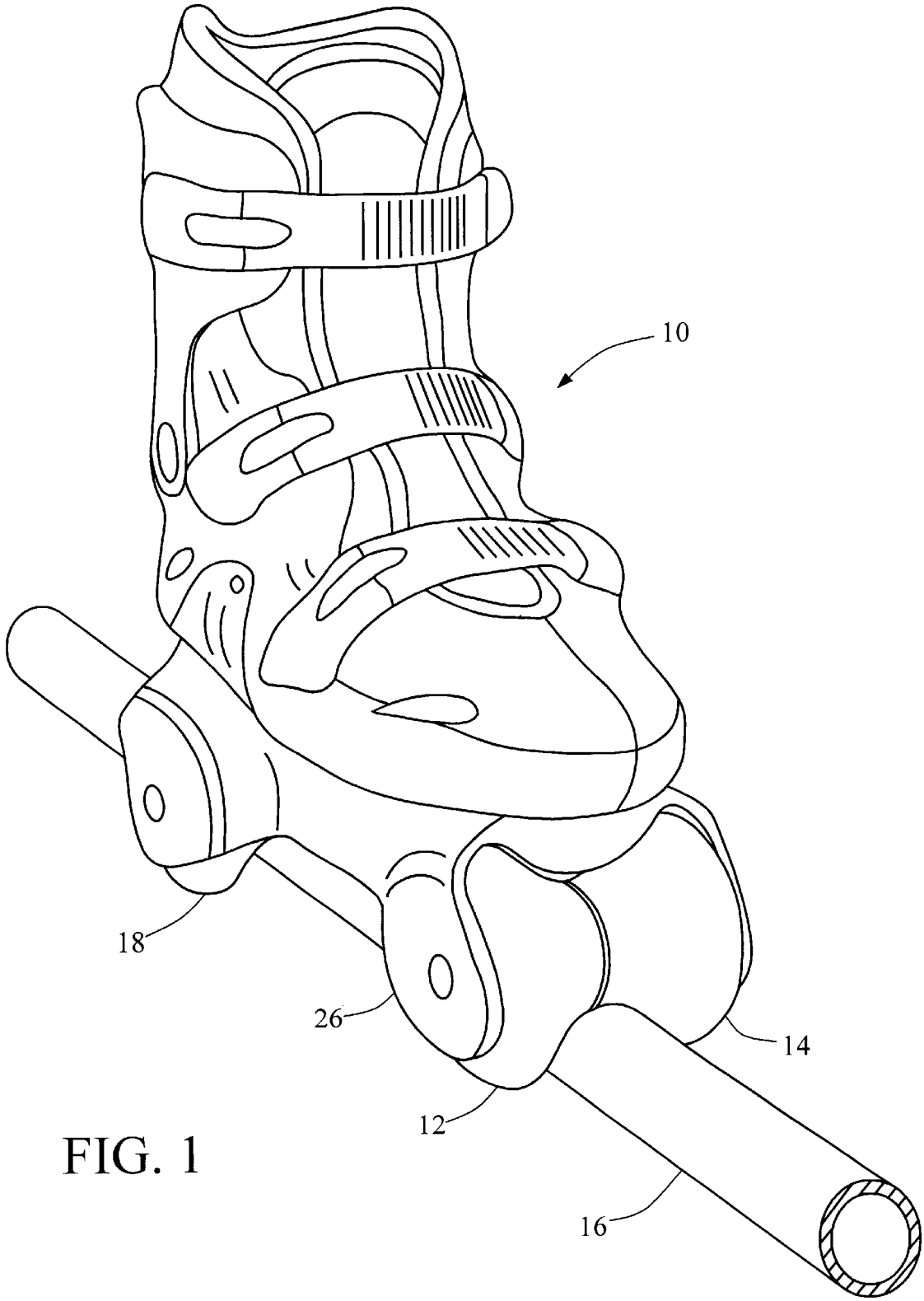
FIG. 1 is a perspective view of a contoured roller skate.

The figures provided display the invention in various views which depict its stated abilities. FIG. 1 shows the skate travelling over a large rail or pipe 16. The two front wheels 12 and 14 and two back wheels 18 and 20 directly engage the surface of the rail due to their concave hourglass shape which is achieved when the wheels are placed adjacent to one another on the same axle as shown. The combined shape of the wheels helps to center the skater when rolling on pipes or rails over the center of balance 22 of the skate.

Figure 2:
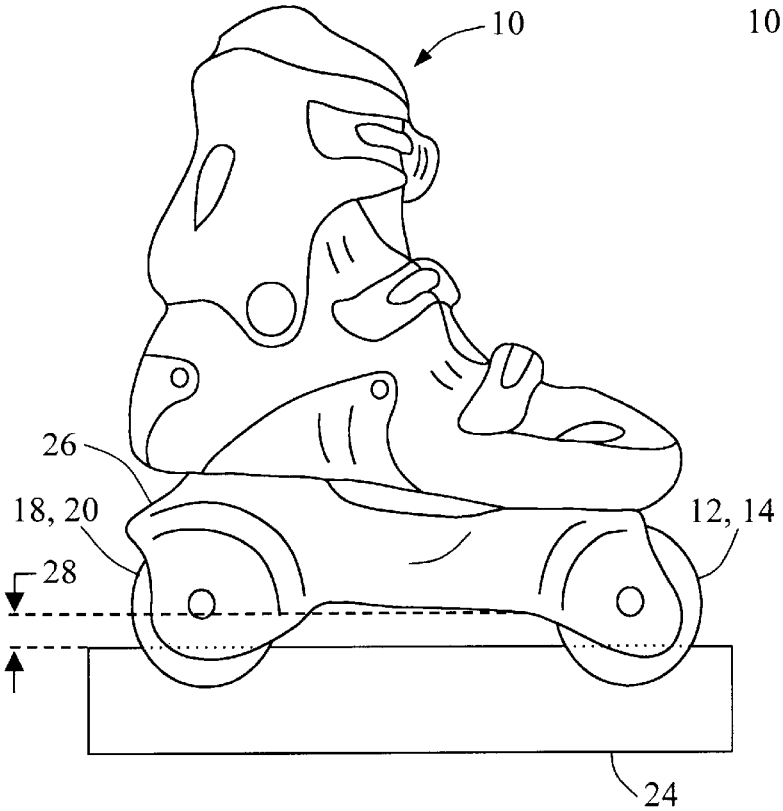
FIG. 2 is a side view of the roller skate.

The side view shown in FIG. 2. shows the location of the front wheels 12 and 14 and the back wheels 18 and 20 relative to the chassis 26 and boot 10. FIG. 2 also shows the ability of the skate to travel over pipe 24 with sufficient clearance 28 between the pipe and chassis 26 as to not interfere with forward or backward travel.

Figure 3:
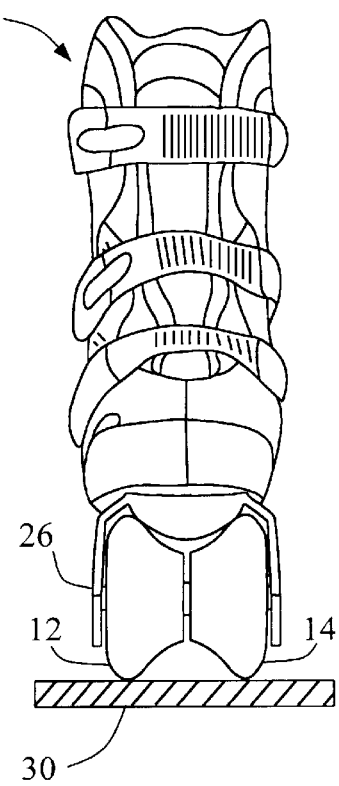
FIG. 3 is a front view of the roller skate.

The front view of the skate shown in FIG. 3 shows the hourglass geometry created when the front wheels 12 and 14 are placed adjacent to each other. The back wheels 18 and 20 have the same geometry as the front wheels. Each wheel 12, 14, 18 and 20 has a concave portion between its innermost edge and an outer portion of greatest diameter. The concave portion of the wheels engage the pipe, while the outer diameters of the wheels make contact with flat surface 30 during regular roller skating.

Figure 4:
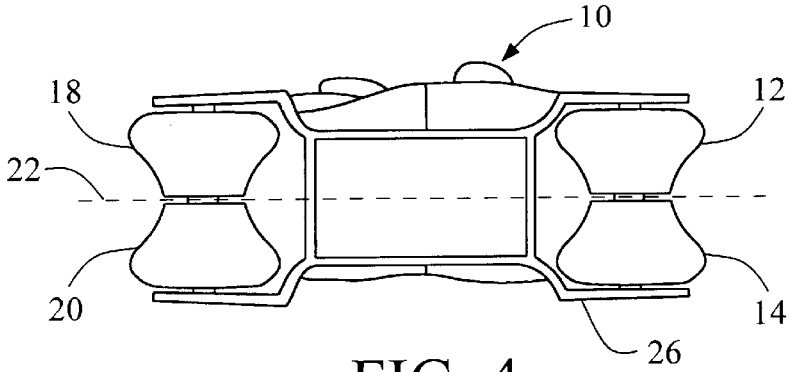
FIG. 4 is a bottom view showing the wheel configuration of the roller skate.

The bottom view of the skate shown in FIG. 4 shows the complete layout of the front wheels 12 and 14 and the back wheels 18 and 20 with the chassis 26 under the boot 10. The separation points between the front and back wheels are directly in-line with each other, along the center of balance of the skate 22. This allows for stability and control while performing tricks on pipes and rails.

Figure 5:
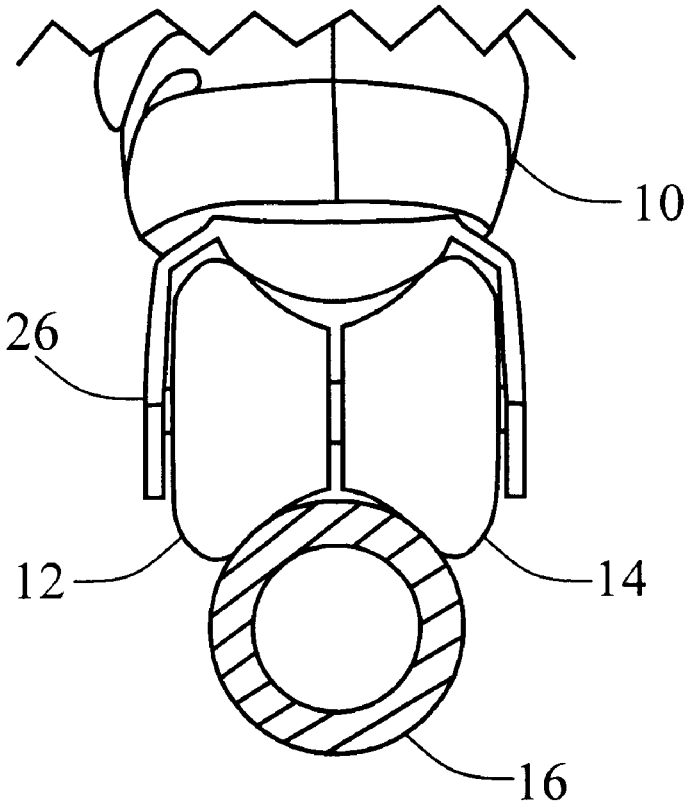
FIGS. 5 and 6 are front views of the roller skate travelling over different size pipes.
Figure 6:
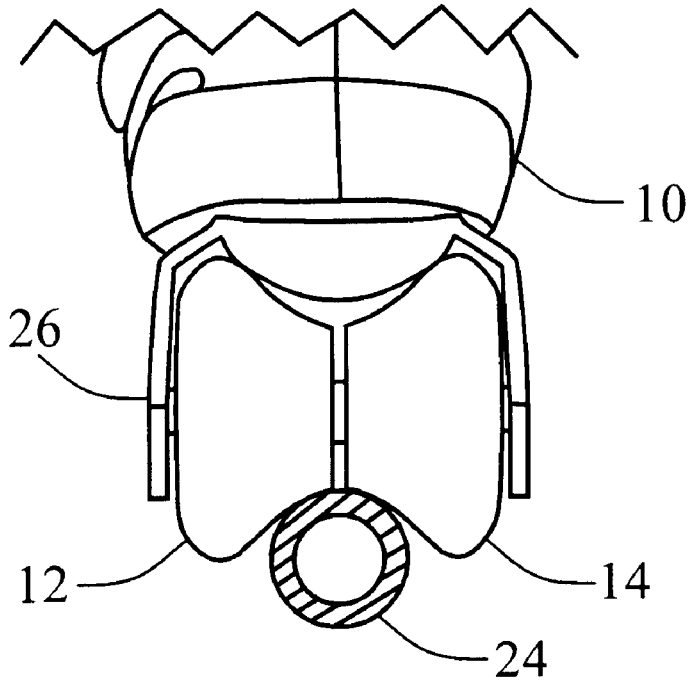

FIG. 5 and FIG. 6 show the front view of the skate and how it engages different size pipes 16 and 24. In FIG. 5, the front wheels 12 and 14 are gripping a large pipe 16. The hourglass geometry of the wheels can accommodate different sized pipes or rails. FIG. 6 shows the front wheels 12 and 14 travelling over a small pipe 24.

The advantage of this invention is the ability to roll over a pipe or rail in the forward or backward direction instead of grinding or scraping. Rolling with the invention is safer and more controllable due to the layout and geometry of the wheels, which gives the skater a secure grip on the pipe or rail surface. Grinding can cause a lack of stability due to leaning in at different angles depending on speed, and placing the skate in the precise location to perform a controlled grind. The hourglass geometry of the wheels of the invention can correct a partially misplaced roll over a pipe or rail and quickly center it over the course of travel.

What is claimed is:

1. A roller skate comprising:

a boot affixed to an elongated chassis which extends longitudinally along a bottom of the boot, the chassis having front and rear wheel receiving portions, each wheel receiving portion having a pair of laterally spaced apart wall members;

a single pair of front wheels mounted adjacent to each other on a front axle extending transversely between the wall members of the front wheel receiving portion for independent rotation about a transverse axis of the front axle; and a single pair of rear wheels mounted adjacent to each other on a rear axle extending transversely between the wall members of the rear wheel receiving portion for independent rotation about a transverse axis of the rear axle;

wherein each wheel has a continuously curved circumferential surface formed by a concave circumferential portion and a convex circumferential portion which are laterally spaced apart, the concave circumferential portions of each pair of wheels forming a substantially continuous single concave surface portion extending between the convex circumferential portions of the pair of wheels when mounted on a respective axle within a respective wheel receiving portion, the single substantially continuous concave surface portion of each pair of wheels being configured for rolling engagement along an elongated member having an arcuate shaped cross-sectional configuration, and the pair of convex circumferential portions of each pair of wheels being configured as a pair of U-shaped ground engaging surfaces for rolling engagement along a ground surface.

* * * * *